US011322126B2

(12) United States Patent
Lee et al.

(10) Patent No.: US 11,322,126 B2
(45) Date of Patent: May 3, 2022

(54) BROADBAND SPARSE ACOUSTIC ABSORBER

(71) Applicant: Toyota Motor Engineering & Manufacturing North America, Inc., Plano, TX (US)

(72) Inventors: Taehwa Lee, Ann Arbor, MI (US); Hideo Iizuka, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 571 days.

(21) Appl. No.: 16/227,345

(22) Filed: Dec. 20, 2018

(65) Prior Publication Data

US 2020/0202831 A1 Jun. 25, 2020

(51) Int. Cl.
*G10K 11/172* (2006.01)
*G10K 11/162* (2006.01)

(52) U.S. Cl.
CPC ..... *G10K 11/172* (2013.01); *G10K 11/162* (2013.01)

(58) Field of Classification Search
CPC ..... G10K 11/172; G10K 11/162
USPC ..... 181/286
See application file for complete search history.

(56) References Cited

U.S. PATENT DOCUMENTS 4,562,901 A * 1/1986 Junger ..... E04B 1/8404 181/285
5,962,823 A * 10/1999 Asahara ..... G10K 11/172 181/286
5,997,985 A * 12/1999 Clarke ..... B32B 3/12 428/116
6,012,543 A * 1/2000 Shimpo ..... B60R 13/08 181/286
7,117,974 B2 * 10/2006 Moenssen ..... F02M 35/1216 181/277
8,307,947 B2 * 11/2012 Bussow ..... F16L 55/0331 181/224
10,978,038 B2 * 4/2021 Lee ..... G10K 11/172
11,043,199 B2 * 6/2021 Lee ..... G10K 11/172
2003/0072459 A1 * 4/2003 Cole ..... B29C 45/006 381/71.7
2003/0173146 A1 * 9/2003 Wolf ..... F02M 35/1211 181/224
2003/0221904 A1 * 12/2003 Ludwig ..... F16L 55/02736 181/224

(Continued)

OTHER PUBLICATIONS

Cheng, Y. et al., "Ultra-sparse metasurface for high reflection of low-frequency sound based on artificial Mie resonances", Nat. Mater., 14, pp. 1013-1020 (2015).

(Continued)

*Primary Examiner* — Forrest M Phillips
(74) *Attorney, Agent, or Firm* — Christopher G. Darrow; Darrow Mustafa PC

(57) ABSTRACT

A broadband sparse acoustic absorber includes a periodic array of spaced apart unit cells, generally having a lateral fill factor less than 0.5. Each unit cell includes a pair of joined, and inverted, Helmholtz resonators, having longitudinal and lateral neck portions that are perpendicular to one another. The longitudinal neck portions are typically covered and/or filled with acoustic absorbing material. Sound suppression systems include sound emitting devices that are at least partially surround by one or more such arrays.

20 Claims, 7 Drawing Sheets

(56) References Cited

U.S. PATENT DOCUMENTS

| | | | | |
|---|---|---|---|---|
| 2005/0045416 | A1* | 3/2005 | McCarty | B01F 5/0456 181/224 |
| 2006/0272886 | A1* | 12/2006 | Mueller | F02C 7/24 181/224 |
| 2010/0077755 | A1* | 4/2010 | Jangili | F16L 55/02754 60/725 |
| 2012/0090915 | A1* | 4/2012 | Cheung | F02M 35/1233 181/224 |
| 2020/0139902 | A1* | 5/2020 | Furuzawa | B60R 13/08 |

OTHER PUBLICATIONS

Cai, C. et al., "Acoustic performance of different Helmholtz resonator array configurations", Appl. Acous., 130, pp. 204-209 (2018).
Lee, T. et al., "Sparse Acoustic Absorber", U.S. Appl. No. 15/962,513, filed Apr. 25, 2018.
U.S. Appl. No. 16/296,403, filed Mar. 8, 2019 (not yet published).
U.S. Appl. No. 16/296,412, filed Mar. 8, 2019 (not yet published).
U.S. Appl. No. 15/962,513, filed Apr. 25, 2018 (not yet published); and.
U.S. Appl. No. 16/025,630, filed Jul. 2, 2018 (not yet published).

* cited by examiner

BROADBAND SPARSE ACOUSTIC ABSORBER

TECHNICAL FIELD

The present disclosure generally relates to acoustic metamaterials and, more particularly, to acoustic absorption metamaterials that are porous to ambient fluid.

BACKGROUND

The background description provided herein is for the purpose of generally presenting the context of the disclosure. Work of the presently named inventors, to the extent it may be described in this background section, as well as aspects of the description that may not otherwise qualify as prior art at the time of filing, are neither expressly nor impliedly admitted as prior art against the present technology.

Acoustic metamaterials having elastic acoustic properties that differ from those of their constituent materials are known. Such metamaterials have arrays of periodic structures, typically on a scale smaller than the target wavelength. Such metamaterials are typically solid surfaces that are impermeable to ambient fluid (e.g. air). Such metamaterials also frequently have narrow ranges of effective absorption frequency.

Accordingly, it would be desirable to provide an improved acoustic material having sparse (spaced apart) unit cells that allow fluid to flow freely between the unit cells, and that have very broad frequency absorption range.

SUMMARY

This section provides a general summary of the disclosure, and is not a comprehensive disclosure of its full scope or all of its features.

In various aspects, the present teachings provide an acoustic absorber. The acoustic absorber includes a periodic array of laterally spaced-apart, two-sided Helmholtz resonators. The periodic array further includes a plurality of unit cells spaced apart by a lateral midpoint-to-midpoint distance P, each unit cell having a maximum lateral dimension W, wherein P is greater than W. Each unit cell includes first and second Helmholtz resonators. The first Helmholtz resonator includes a first chamber portion bounded by at least one first boundary wall defining a first chamber volume and having a longitudinal neck placing the second chamber portion in fluid communication with the ambient environment. The second Helmholtz resonator includes a second chamber portion bounded by at least one second boundary wall defining a second chamber volume and having a lateral neck forming an opening on a second side of the at least one second boundary wall and placing the second chamber portion in fluid communication with the ambient environment. The first side of the at least one first boundary wall and the second side of the at least one second boundary wall are substantially perpendicular to each other, and the second chamber volume is equal to the first chamber volume.

In other aspects, the present teachings provide a layered broadband sparse acoustic absorber. The acoustic absorber includes a periodic array of laterally spaced-apart, two-sided Helmholtz resonators. The periodic array further includes a plurality of unit cells spaced apart by a lateral midpoint-to-midpoint distance P, each unit cell having a maximum lateral dimension W, wherein P is greater than W. Each unit cell includes first and second Helmholtz resonators. The first Helmholtz resonator includes a first chamber portion bounded by at least one first boundary wall defining a first chamber volume and having a longitudinal neck placing the first chamber portion in fluid communication with the ambient environment. The second Helmholtz resonator includes a second chamber portion bounded by at least one second boundary wall defining a second chamber volume and having a lateral neck forming an opening on a second side of the at least one second boundary wall and placing the second chamber portion in fluid communication with the ambient environment. The first side of the at least one first boundary wall and the second side of the at least one second boundary wall are substantially perpendicular to each other, and the second chamber volume is equal to the first chamber volume. The layered broadband sparse acoustic absorber further includes a second plurality of unit cells, layered relative to the first plurality, and having third and fourth Helmholtz resonators. The third Helmholtz resonator includes a third chamber portion bounded by at least one third boundary wall defining a third chamber volume and having a second longitudinal neck placing the third chamber portion in fluid communication with the ambient environment. The fourth Helmholtz resonator includes a fourth chamber portion bounded by at least one fourth boundary wall defining a fourth chamber volume and having a lateral neck forming an opening on a fourth side of the at least one fourth boundary wall and placing the fourth chamber portion in fluid communication with the ambient environment. The third side of the at least one third boundary wall and the fourth side of the at least one fourth boundary wall are substantially perpendicular to each other, and the third chamber volume is equal to the fourth chamber volume.

In still other aspects, the present teachings provide a sound suppression system for a sound emitting device. The system includes a sound emitting device, such as an internal combustion engine. The system further includes a periodic array of laterally spaced-apart, two-sided Helmholtz resonators. The periodic array further includes a plurality of unit cells spaced apart by a lateral midpoint-to-midpoint distance P, each unit cell having a maximum lateral dimension W, wherein P is greater than W. Each unit cell includes first and second Helmholtz resonators. The first Helmholtz resonator includes a first chamber portion bounded by at least one first boundary wall defining a first chamber volume and having a longitudinal neck placing the second chamber portion in fluid communication with the ambient environment. The second Helmholtz resonator includes a second chamber portion bounded by at least one second boundary wall defining a second chamber volume and having a lateral neck forming an opening on a second side of the at least one second boundary wall and placing the second chamber portion in fluid communication with the ambient environment. The first side of the at least one first boundary wall and the second side of the at least one second boundary wall are substantially perpendicular to each other, and the second chamber volume is equal to the first chamber volume.

Further areas of applicability and various methods of enhancing the disclosed technology will become apparent from the description provided herein. The description and specific examples in this summary are intended for purposes of illustration only and are not intended to limit the scope of the present disclosure.

BRIEF DESCRIPTION OF THE DRAWINGS

The present teachings will become more fully understood from the detailed description and the accompanying drawings, wherein.

It should be noted that the figures set forth herein are intended to exemplify the general characteristics of the methods, algorithms, and devices among those of the present technology, for the purpose of the description of certain aspects. These figures may not precisely reflect the characteristics of any given aspect, and are not necessarily intended to define or limit specific embodiments within the scope of this technology. Further, certain aspects may incorporate features from a combination of figures.

DETAILED DESCRIPTION

The present technology provides an asymmetric, unidirectional noise attenuation structure, and various devices built from the structure. The structure has a sparse periodic structure, with open space between adjacent unit cells, allowing fluid to flow freely through the structure. The unique design of the structure enables it to exhibit very broadband acoustic absorption, that is tunable to a desired frequency range.

The broadband sparse absorber is based on a unit cell having an inverted, asymmetric pair of Helmholtz resonators. Arrays of such unit cells can be stacked in high frequency and low frequency layers, enhancing the frequency range of high efficiency absorption. The broadband sparse absorption structures have unique applicability in any application that benefits from sound dampening, while allowing air or other fluid to pass freely through. In an example, the broadband sparse absorber can surround a vehicle engine, rendering the engine substantially silent while allowing air or liquid coolant to pass through to the engine.

Figure 1A:
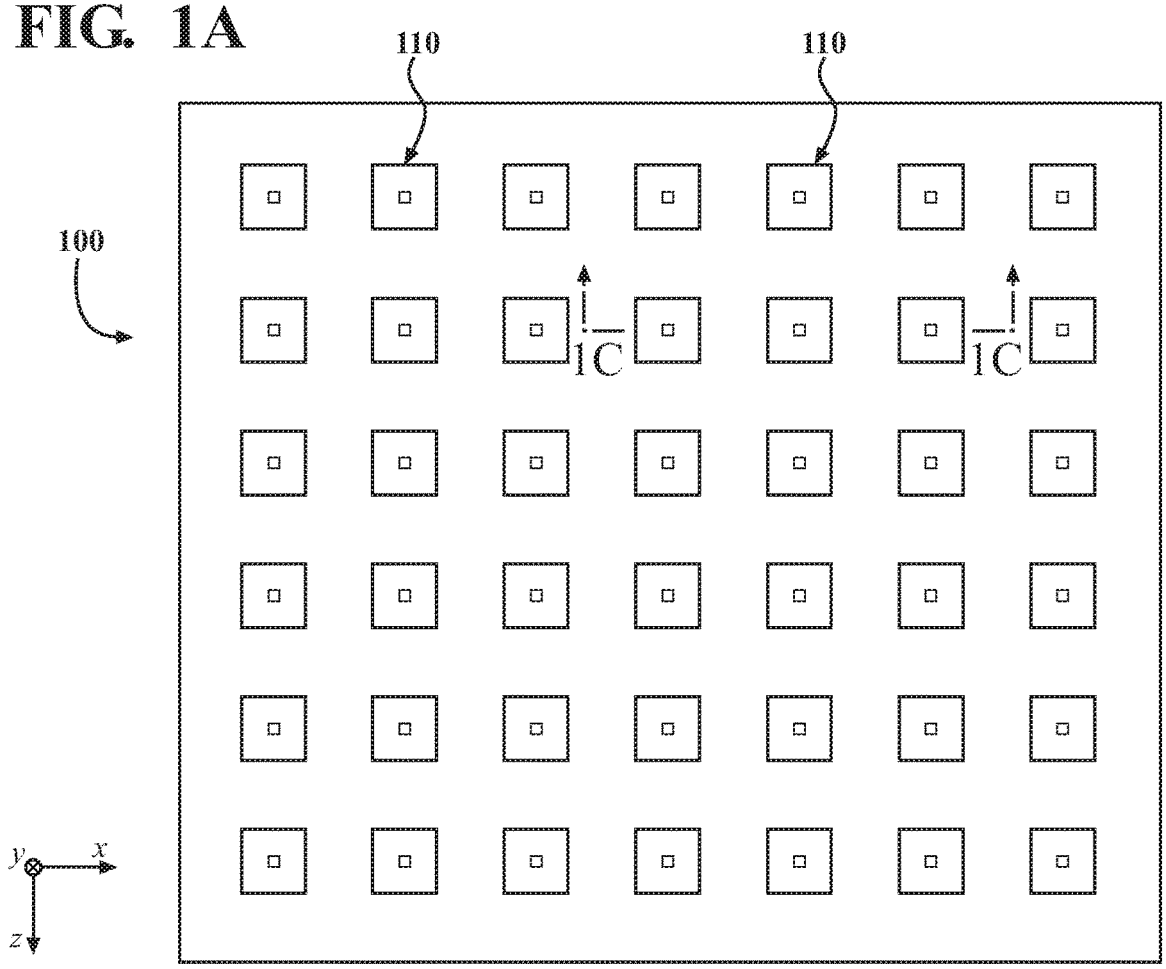
FIG. 1A is a schematic top plan view of a portion of a broadband sparse acoustic absorber.
Figure 1B:
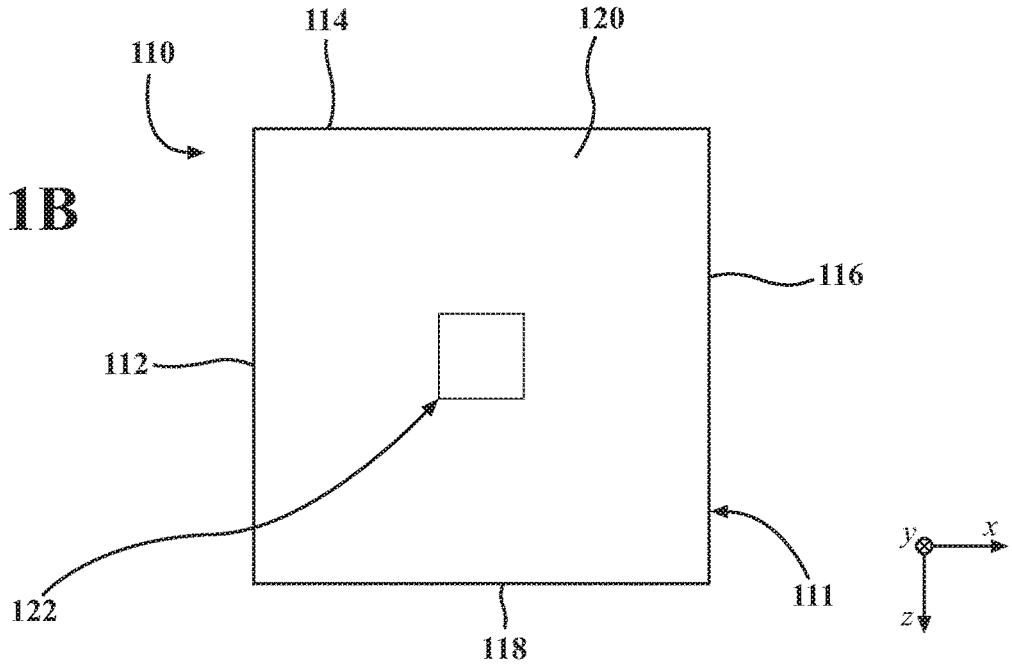
FIG. 1B is a magnified view of a unit cell of the absorber of FIG. 1A.
Figure 1C:
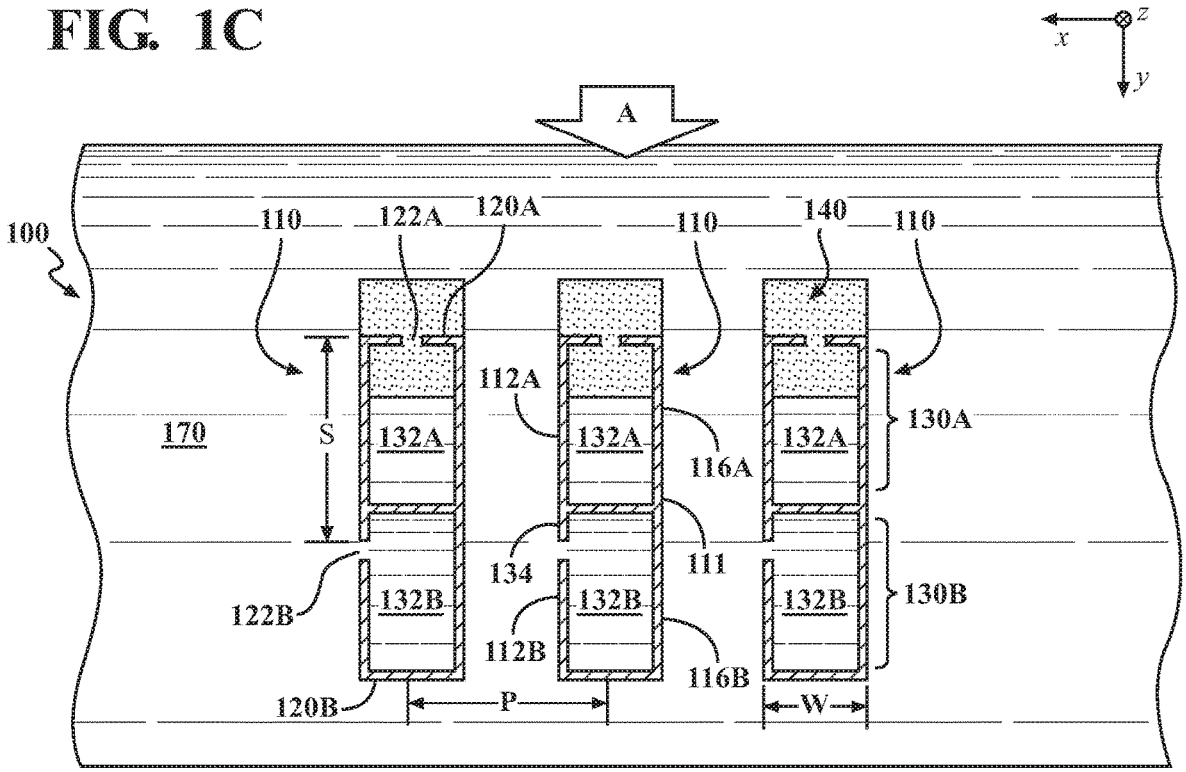
FIG. 1C is a schematic side cross-sectional view of three unit cells of the absorber of FIG. 1A, viewed along the line 1C-1C.

FIG. 1A shows a top plan view of a portion of a disclosed broadband sparse acoustic absorber 100, having an array of periodic unit cells 110, while FIG. 1B shows a magnified view a single unit cell 110, viewed from the same direction as in the view of FIG. 1A. FIG. 1C shows a side cross-sectional view, taken along the line 1C-1C from FIG. 1A, of a portion of sparse acoustic absorber 100 of FIG. 1A, and including only three unit cells 110. With particular reference to FIG. 1A, the unit cells 110 can be periodic in 2-dimensions (e.g. the x, z dimensions of FIG. 1A), as in the example of FIG. 1A. Each unit cell 110 includes at least one enclosure wall, although the unit cell 110 of FIGS. 1A-1C includes multiple enclosure walls, such as side walls 112, 114, 116, and 118, and end wall 120, as indicated in FIG. 1B. Each unit cell 110 further includes a neck 122, defining an aperture passing through the end wall 120.

In the example of FIG. 1A, the periodic array of unit cells 110 has periodicity in both x and z dimensions. This can be termed a two-dimensional array. While the unit cells 110 of FIG. 1A are shown as having a substantially square surface profile, they can alternately have a surface profile that is non-square rectangular, circular, triangular, ovoid, or any other regular shape. In some implementations in which the periodic array of unit cells 110 is a two-dimensional array, the two-dimensional array can have 90° rotational symmetry about an axis perpendicular to the surface of the absorber 100.

With particular reference to FIG. 1C, the period, P, of the periodic array of unit cells 110 will generally be substantially smaller than the wavelength of the acoustic waves that the sparse acoustic absorber 100 is designed to absorb. As shown in FIG. 1C, the period can be equated to a center-to-center distance between adjacent unit cells. In different implementations, the period of the periodic array of unit cells 110 will be within a range of from about 0.1 to about 0.75, inclusive, of the wavelength of the acoustic waves that the broadband sparse acoustic absorber 100 is designed to absorb, i.e. the wavelength corresponding to the resonance frequency discussed below. In certain particular implementations, the period of the periodic array of unit cells 110 will be within a range of from about 0.25 to about 0.5 of the resonance wavelength. For example, in some implementations, the broadband sparse acoustic absorber 100 can be designed to absorb acoustic waves of a human-audible frequency, having a wavelength within a range of from about 17 mm to about 17 m, or some intermediate value contained within this range.

Figure 1D:
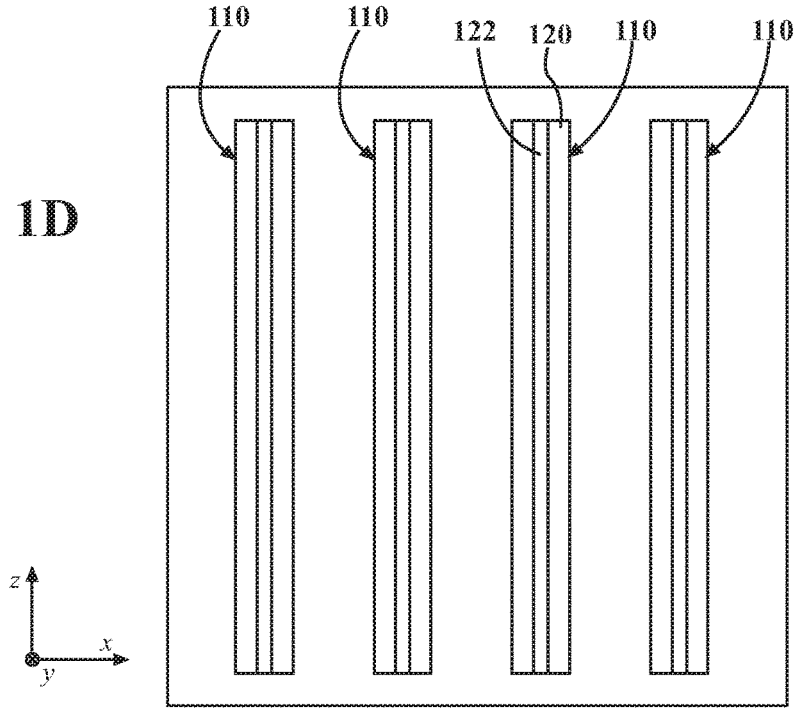
FIG. 1D is a top plan view of a variant of the sparse acoustic absorber of the type shown in FIG. 1A, having a one-dimensional array of unit cells.
Figure 1E:
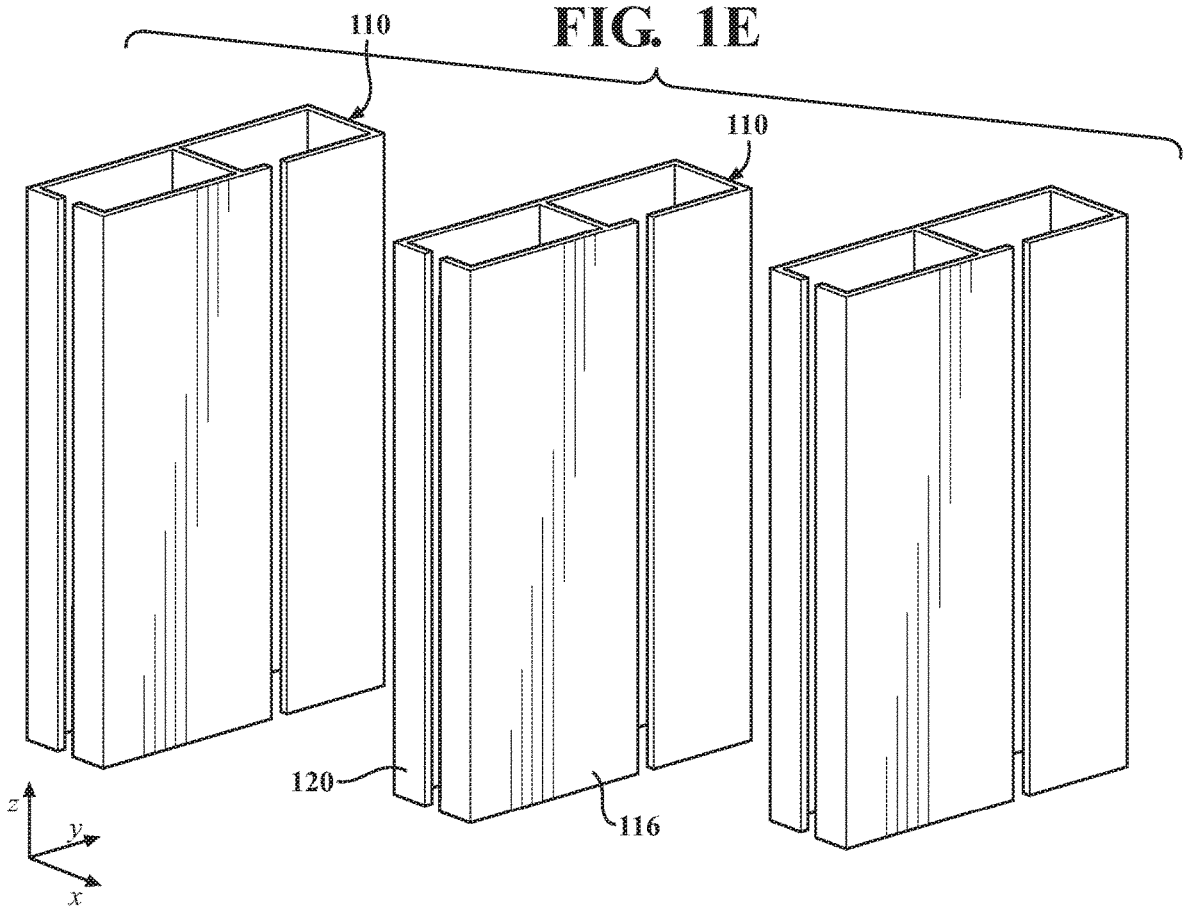
FIG. 1E is a perspective view of several unit cells of the one-dimensional array of FIG. 1D.

With reference to FIGS. 1D and 1E, the periodic array of unit cells 110 can alternatively be periodic in one dimension only. FIG. 1D shows a top plan view of such a one-dimensional periodic array of unit cells 110, periodic in the x-dimension, and FIG. 1E shows a perspective view of the array of FIG. 1D. As shown in the example of FIGS. 1D and 1E, when an array is periodic in one-dimension (e.g. the x-dimension), each unit cell 110 will typically be elongated in the z-dimension.

With continued reference to FIG. 1C, each unit cell 110 of the periodic array of unit cells 110 will generally have a maximum lateral dimension, or width W. It will be understood that in the case of a one-dimensional array, such as that of FIGS. 1D and 1E, the maximum lateral dimension is only in the direction of periodicity (e.g. the x-dimension), and not in the elongated direction (e.g. the z-dimension). The periodic array of unit cells 110 is further characterized by a fill factor equal to W/P. In general, the fill factor will be 0.5 or less. In some implementations, the fill factor will be 0.25 (i.e. 25%) or less. It will be appreciated that the frequency breadth of efficient absorption of the broadband sparse acoustic resonator 100 (i.e. the broadband nature of absorption) is substantially determined by the fill factor of the periodic array of unit cells 110; the ratio of width to period of unit cells 110. Thus, a large fill factor (W/P) increases the frequency bandwidth, whereas small fill factor (high sparsity) decreases the bandwidth of efficient absorption. As noted above, the period of the periodic array of unit cells 110 is smaller than the wavelength corresponding to the desired resonance frequency (period<wavelength). At the same time, in many implementations the period and width of unit cells 110 will be chosen so that the periodic array of unit cells 110 has a fill factor of at least 0.2 (i.e. 20%).

In some implementations, the unit cells 110 of the broadband sparse acoustic absorber 100 can be positioned periodically on a porous substrate, through which ambient fluid 170 can pass with little constraint. Such a porous substrate could be a mesh or screen, such as an air screen of the type used in a window, a sheet of material having periodic apertures or perforations, or any other suitable substrate.

Referring now more particularly to FIG. 1C, each unit cell 110 of the sparse acoustic absorber 100 includes first and second Helmholtz resonators 130A and 130B. Each of the first and second Helmholtz resonators 130A, 130B includes a chamber 132A, 132B, respectively, bounded by the at least one enclosure wall 111 and by at least one partition wall 134. In the example illustrated in FIG. 1B, the first Helmholtz resonator 130A is bounded by side walls 112A and 116A; by the end wall 120A; and by the partition wall 134; as well as by side walls 114A and 118A which are not visible in the view of FIG. 1C. Similarly, the second Helmholtz resonator 130B is bounded by side walls 112B and 116B; by the end wall 120B; and by the partition wall 134; as well as by side walls 114B and 118B which are not visible in the view of FIG. 1C.

The first Helmholtz resonator 130A has a longitudinal neck 122A that provides an opening, parallel to a longitudinal axis of the resonator 130A (e.g. the y-axis of FIG. 1C), through the end wall 120A, and thereby places the chamber 132A in fluid communication with the ambient environment. When the broadband sparse acoustic absorber 100 is in operation, the longitudinal neck 122A will typically face the direction of incident acoustic waves. The second Helmholtz resonator 130B has a lateral neck 122B, that provides an opening, parallel to a lateral axis of the resonator 130B (e.g. the x-axis of FIG. 1C), through a side wall (e.g. 112B or 114B), and thereby places the chamber 132B in fluid communication with the ambient environment. When the broadband sparse acoustic absorber 100 is in operation, the lateral neck 122B will typically face a direction perpendicular. The longitudinal neck 122A and the lateral neck 122B are separated by a longitudinal distance, S, as shown in FIG. 1C.

Figure 2A:
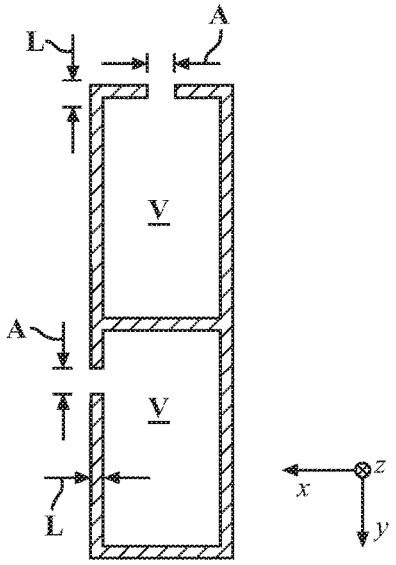
FIG. 2A is a side sectional view of a single unit cell of a broadband sparse acoustic absorber, highlighting geometric parameters of the unit cell.

FIG. 2A shows a side cross-sectional view of a unit cell 110 of the broadband sparse acoustic absorber 100. As shown in FIG. 2A, each of the longitudinal neck 122A and the lateral neck 122B can be characterized by a neck length, L, and a neck cross-sectional surface area, A. It will be understood that each Helmholtz resonator 130A, 130B of the unit cell 110 has a resonance frequency determined by Equation 1:

$$f = \frac{c}{2\pi}\sqrt{\frac{A}{VL}}. \quad (1)$$

where f is the resonance frequency of the Helmholtz resonator; c is the speed of sound in the ambient fluid; A is the cross-sectional area of the neck; Vis the chamber volume; and L is the neck length.

While the unit cell 110 of FIGS. 1A and 1B defines a substantially rectangular prismatic shape, it is to be understood that a unit cell 110 of the present teachings can include any suitable shape, such as cylindrical, conical, spherical, ovoid, or any other shape that is suitable to enclose first and second Helmholtz resonators 130A, 130B separated by at least one partition wall 134.

It will further be understood that each chamber 132A, 132B defines a volume, corresponding to the volume of ambient fluid 170 that can be held in the chamber 132A, 132B, exclusive of the neck 122A, 122B. The volume of the first and second Helmholtz resonators 130A, 130B will generally be the same. Thus, and with renewed reference to Equation 1, the first and second Helmholtz resonators 130A, 130B will generally be the same.

The at least one enclosure wall and the end wall 120 will typically be formed of a solid, sound reflecting material. In general, the material or materials of which the at least one enclosure wall and the end wall 120 are formed will have acoustic impedance higher than that of ambient fluid 170. Such materials can include a thermoplastic resin, such as polyurethane, a ceramic, or any other suitable material.

With continued reference to FIG. 1C, the broadband sparse acoustic absorber 100 can include an acoustically absorbing medium 140 overlaying and/or partially filling each first Helmholtz resonator 130A. In the example of FIG. 1C, the acoustically absorbing medium 140 overlays each first Helmholtz resonator 130A and contiguously fills the longitudinal neck 122A, as described above, and also fills an adjacent portion of the chamber 132A. The acoustically absorbing medium 140 can be a highly absorptive porous medium, such as a melamine or polyurethane foam, or any other medium having thermal dissipative acoustic properties. In some implementations, the acoustically absorbing medium 140 will have a porosity greater than 0.5 or 0.6, or 0.7, or 0.8 or 0.9.

Figure 2B:
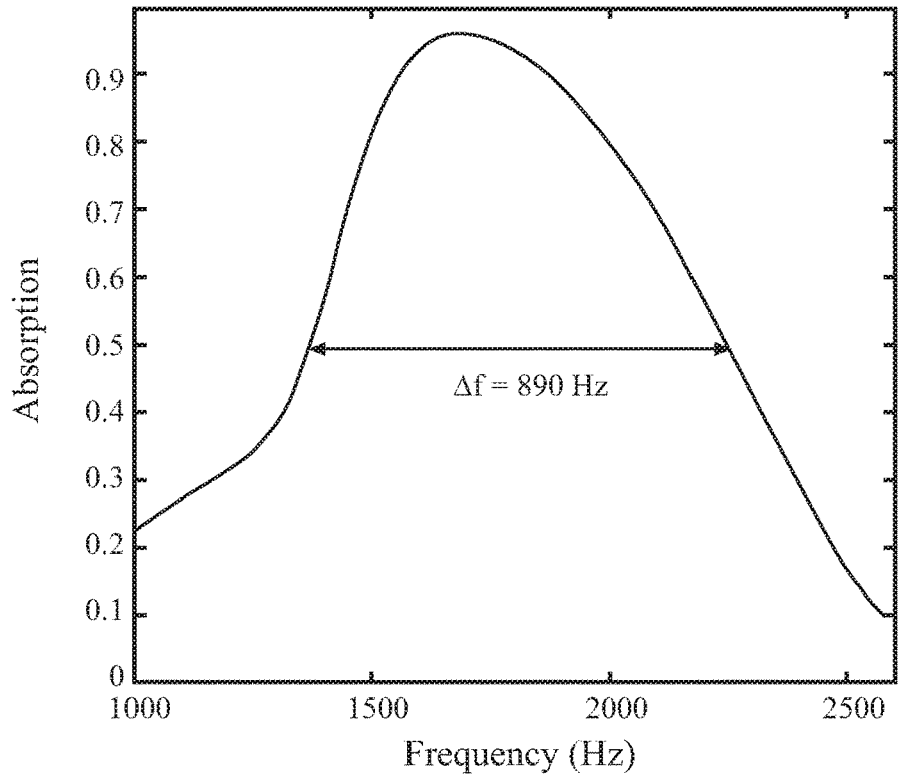
FIG. 2B is a graph of acoustic absorption as a function of frequency for a broadband sparse acoustic absorber of FIGS. 1D and 1E and having an acoustically absorbing medium covering and filling longitudinal necks of the unit cells.
Figure 2C:
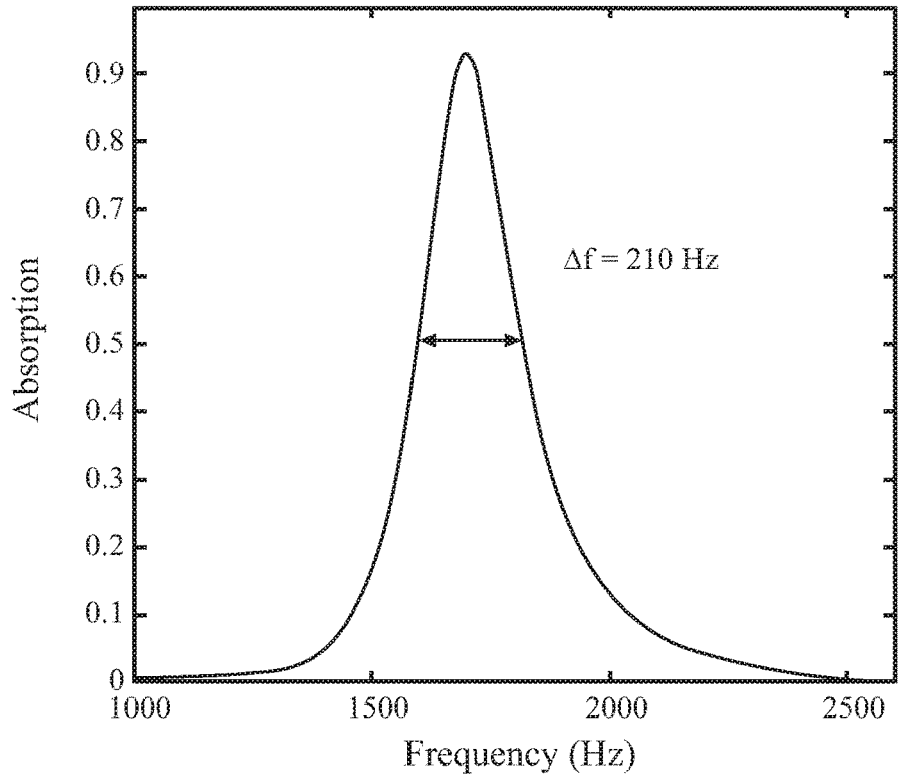
FIG. 2C is a graph of acoustic absorption as a function of frequency for a broadband sparse acoustic absorber of FIGS. 1D and 1E and lacking an acoustically absorbing medium covering and filling longitudinal necks of the unit cells.

FIGS. 2B and 2C show plots of acoustic absorption as a function of frequency for a sparse acoustic absorber 100 of the present teachings either possessing or lacking the acoustically absorbing medium 140 described above. The broadband sparse acoustic absorber 100 of FIGS. 2B and 2C have identical geometries of first and second Helmholtz resonators 130A, 130B, with resonance frequency, f, of about 1700 Hz. The broadband sparse acoustic absorber 100 of FIG. 2B has considerably broadband absorption, with a full width at half maximum (Δf) of about 890 Hz. In contrast, the absorber 100 of FIG. 2C exhibits a considerably narrower absorption profile, with Δf of about 210 Hz; only 25% as broad as that of FIG. 2B. These results demonstrate that the layer of acoustic absorbing medium 140 can substantially increase breadth of absorption.

Figure 3:
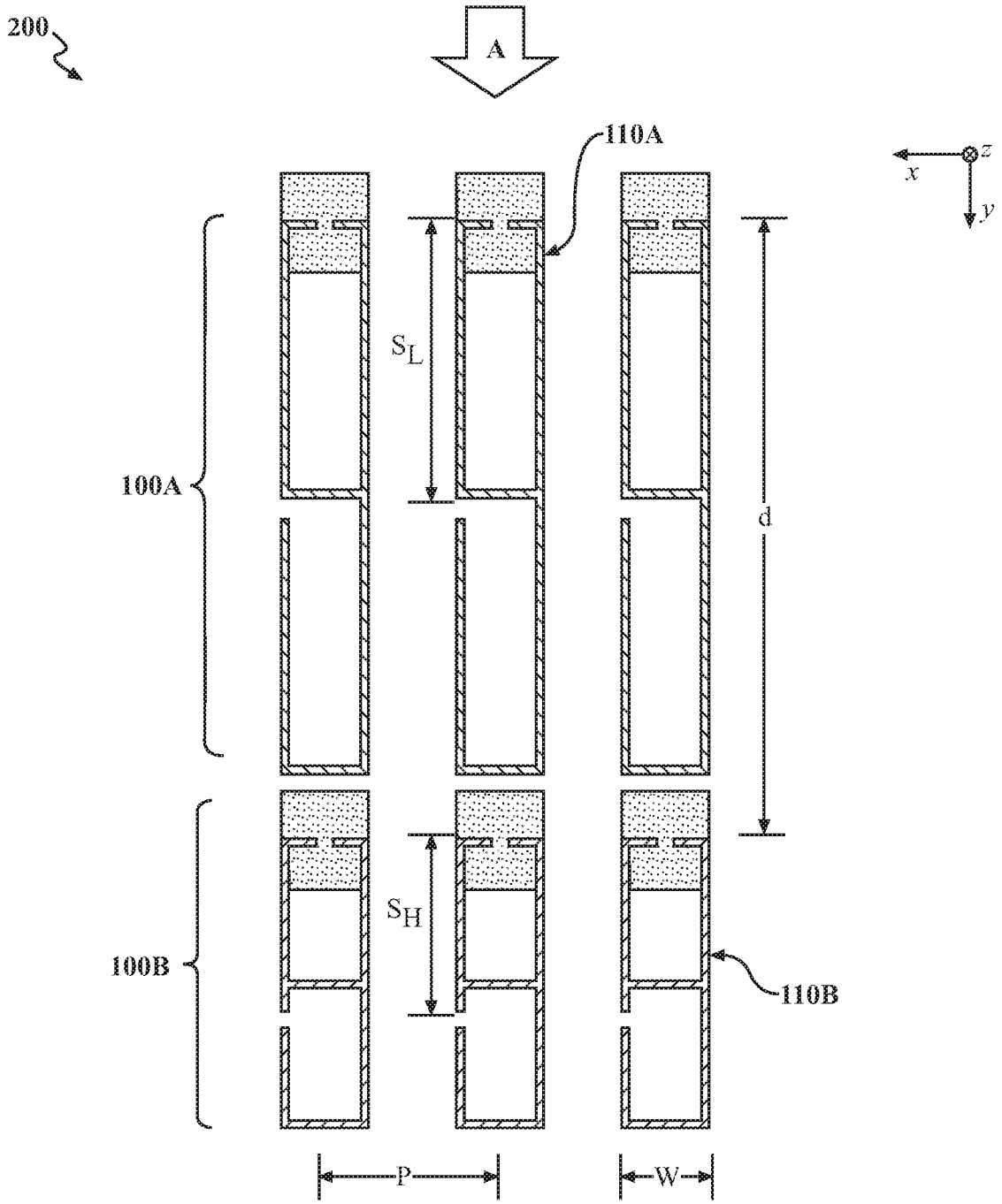
FIG. 3 is a schematic sectional view of a portion of a layered broadband sparse acoustic absorber.

In some implementations, two or more broadband sparse acoustic absorber 100 arrays can be layered to create a stacked broadband sparse acoustic absorber 200 and increase breadth of absorption. FIG. 3 shows an example of such an implementation, having a first broadband sparse acoustic absorber layer 100A, and a second broadband sparse acoustic absorber layer 100B, stacked longitudinally (i.e. in the y-dimension of FIG. 3) relative to the first layer 100A. This arrangement can alternatively be referred to as the first and second broadband sparse acoustic absorbers 100A, 100B forming a layered stack relative to one another. The first and second layers 100A, 100B have different geometries, including different chamber volumes, of their Helmholtz resonators 130A, 130B, such that the first layer 100A has a resonance frequency, $f_H$=1700 Hz while the second layer 100B has a resonance frequency, $f_L$=1000 Hz.

Similarly, the longitudinal distances, $S_H$ and $S_L$, of the first and second broadband sparse acoustic absorbers 110A, 110B can differ from one another.

Figure 4:
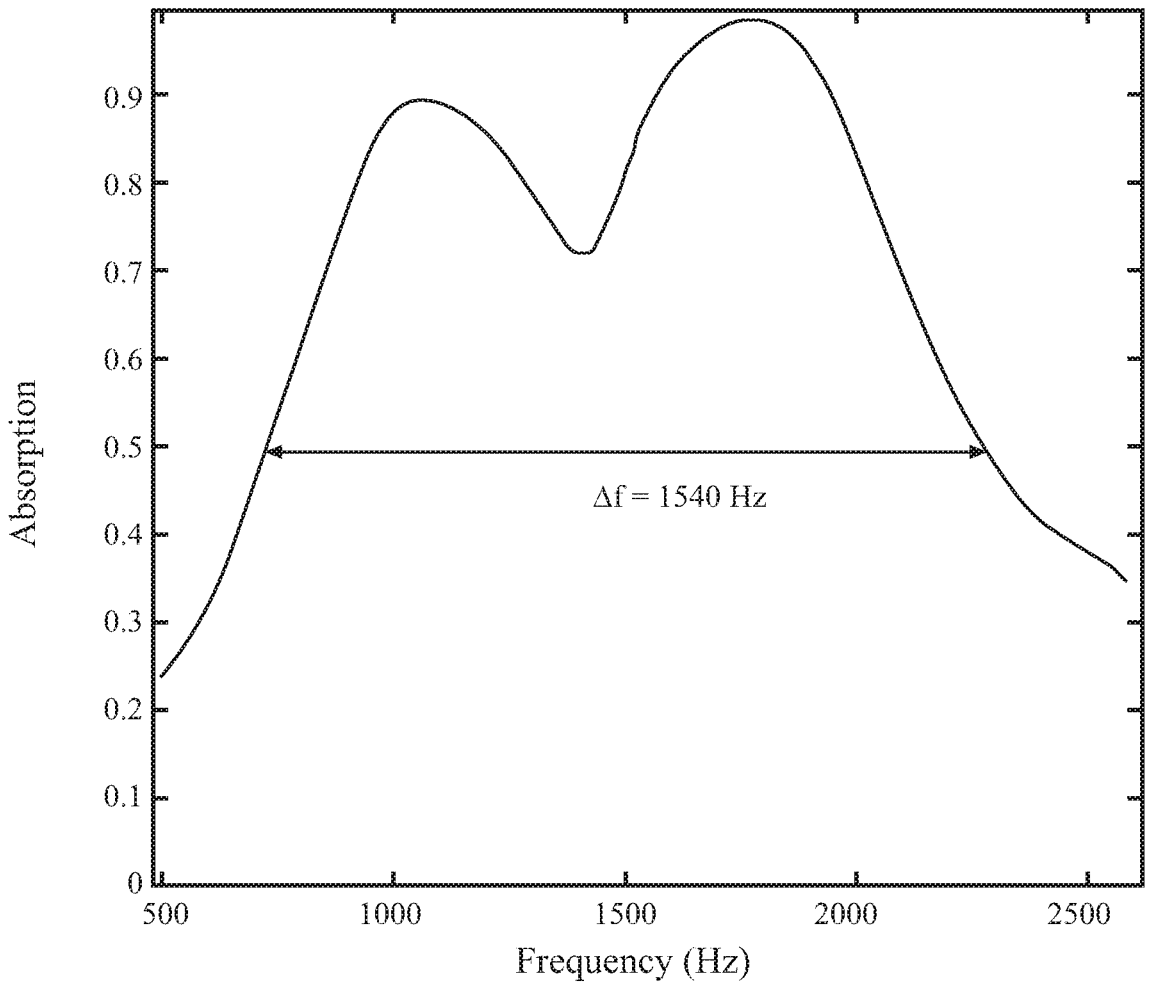
FIG. 4 is a graph of acoustic absorption as a function of frequency for a layered broadband sparse acoustic absorber of FIG. 3.

FIG. 4 shows acoustic absorbance as a function of frequency for the stacked absorber 200 of FIG. 3. The full width at half maximum, Δf is about 1540 Hz, nearly double that of the single layer broadband sparse acoustic absorber 100 of FIG. 2B.

Figure 5:
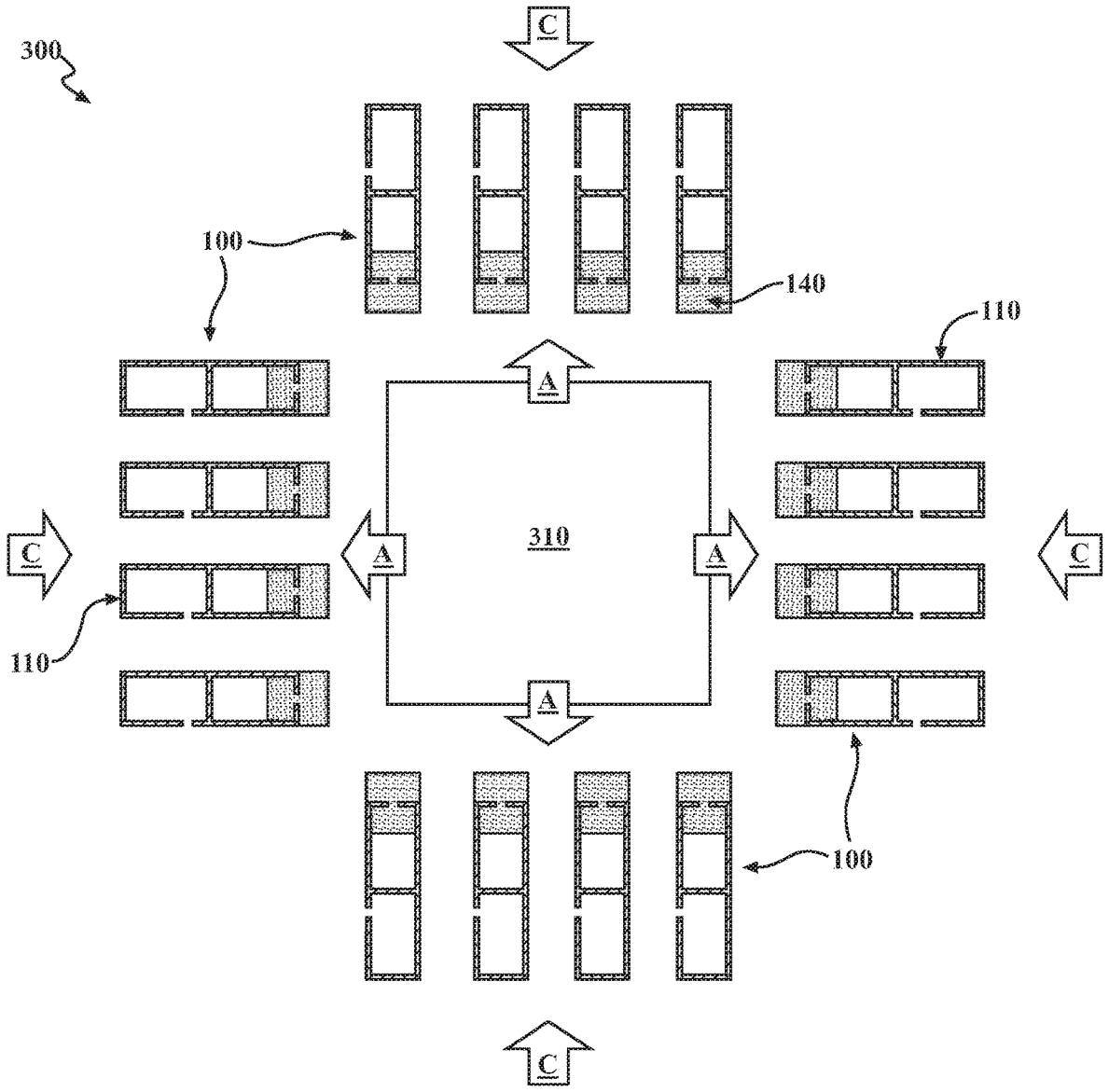
FIG. 5 is a schematic plan view of a sound suppression system incorporating a broadband sparse acoustic absorber of the type shown in FIGS. 1A-1E or FIG. 3.

FIG. 5 shows a plan view of a disclosed sound suppression system 300 for a sound emitting device 310. The sound suppression system 300 of FIG. 5 includes the sound emitting device 310, that is at least partially surrounded by one or more broadband sparse acoustic absorbers 100 of the type described above. In general, the longitudinal necks 122A of the one or more broadband sparse acoustic absorbers 100 will face the sound emitting device 310, as shown. In some implementations, the one or more broadband sparse acoustic absorbers 100 of the sound suppression system 300 can include one or more stacked broadband sparse acoustic absorbers 200 of the type described above in relation to FIG. 3.

While the sound emitting device 310 is shown abstractly and generically as a square in the stylized view of FIG. 5, it can be any device that emits sound under conditions in which sound suppression is desirable. In certain implementations, the sound emitting device 310 can an internal combustion engine, such as an internal combustion engine of a motor vehicle. In such implementations, the internal combustion engine emits sound (represented by block arrows, A), and also must be in external fluid communication with coolant (represented by block arrows, C), and/or potentially other fluids. Thus, in some implementations, the sound suppression system 300 includes a coolant, configured to absorb heat from the sound emitting device 310, passing through interstices in the one or more broadband sparse acoustic absorbers 100 (i.e. passing through one or more spaces between adjacent unit cells 110).

In instances in which the one or more broadband sparse acoustic absorbers 100 include one or more one-dimensional arrays of the type discussed above in reference to FIG. 1D, the elongated unit cells 110 of the array can be attached to a support structure, such as to fixed brackets in an engine compartment. In instances in which the one or more broadband sparse acoustic absorbers 100 include one or more two-dimensional arrays of the type discussed above in reference to FIG. 1A, unit cells 100 of the array can be supported by a porous substrate such as a mesh or screen. In some implementations, the one or more broadband sparse acoustic absorbers 100 of the sound suppression system 300 can surround the sound emitting device 310 on all sides, such as by forming the walls of a cubicle or rectangular prismatic enclosure. In other such implementations, the one or more broadband sparse acoustic absorbers 100 can be curved or otherwise form a spherical or ovoid enclosure about the sound emitting device 310.

The preceding description is merely illustrative in nature and is in no way intended to limit the disclosure, its application, or uses. As used herein, the phrase at least one of A, B, and C should be construed to mean a logical (A or B or C), using a non-exclusive logical "or." It should be understood that the various steps within a method may be executed in different order without altering the principles of the present disclosure. Disclosure of ranges includes disclosure of all ranges and subdivided ranges within the entire range.

The headings (such as "Background" and "Summary") and sub-headings used herein are intended only for general organization of topics within the present disclosure, and are not intended to limit the disclosure of the technology or any aspect thereof. The recitation of multiple embodiments having stated features is not intended to exclude other embodiments having additional features, or other embodiments incorporating different combinations of the stated features.

As used herein, the terms "comprise" and "include" and their variants are intended to be non-limiting, such that recitation of items in succession or a list is not to the exclusion of other like items that may also be useful in the devices and methods of this technology. Similarly, the terms "can" and "may" and their variants are intended to be non-limiting, such that recitation that an embodiment can or may comprise certain elements or features does not exclude other embodiments of the present technology that do not contain those elements or features.

The broad teachings of the present disclosure can be implemented in a variety of forms. Therefore, while this disclosure includes particular examples, the true scope of the disclosure should not be so limited since other modifications will become apparent to the skilled practitioner upon a study of the specification and the following claims. Reference herein to one aspect, or various aspects means that a particular feature, structure, or characteristic described in connection with an embodiment or particular system is included in at least one embodiment or aspect. The appearances of the phrase "in one aspect" (or variations thereof) are not necessarily referring to the same aspect or embodiment. It should be also understood that the various method steps discussed herein do not have to be carried out in the same order as depicted, and not each method step is required in each aspect or embodiment.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations should not be regarded as a departure from the disclosure, and all such modifications are intended to be included within the scope of the disclosure.

What is claimed is:

1. A broadband sparse acoustic absorber comprising a periodic array of laterally spaced-apart, two-sided Helmholtz resonators, the periodic array comprising:

a plurality of unit cells spaced apart by a lateral midpoint-to-midpoint distance P, each unit cell having a maximum lateral dimension W, wherein P is greater than W, and each unit cell comprising:

a first Helmholtz resonator having:

a first chamber portion bounded by at least one first boundary wall defining a first chamber volume; and a longitudinal neck forming an opening on a first side of the at least one first boundary wall and placing the first chamber portion in fluid communication with an ambient environment; and a second Helmholtz resonator having:

a second chamber portion bounded by at least one second boundary wall defining a second chamber volume equal to the first chamber volume; and a lateral neck forming an opening on a second side of the at least one second boundary wall, the second side being substantially perpendicular to the first side, and placing the second chamber portion in fluid communication with the ambient environment.

2. The broadband sparse acoustic absorber as recited in claim 1, comprising an acoustically absorbing medium covering the longitudinal neck of each unit cell.

3. The broadband sparse acoustic absorber as recited in claim 1, comprising an acoustically absorbing medium covering the longitudinal neck, and contiguously filling the longitudinal neck and a fraction of the first chamber portion of each unit cell.

4. The broadband acoustic absorber as recited in claim 3, wherein the acoustically absorbing medium comprises a melamine or polyurethane foam.

5. The broadband sparse acoustic absorber as recited in claim 1, wherein W is less than or equal to 0.25 P.

6. The broadband sparse acoustic absorber as recited in claim 1, wherein P is within a range of from about one-quarter to one-half of a resonance wavelength of the absorber.

7. The broadband sparse acoustic absorber as recited in claim 1, wherein the periodic array of unit cells comprises a two-dimensional array.

8. The broadband sparse acoustic absorber as recited in claim 7, wherein the two-dimensional array comprises:

unit cells spaced apart by an equivalent lateral midpoint-to-midpoint distance, P, in the first and second dimensions;

wherein each unit cell has an equivalent maximum lateral dimension W, in each of the two dimensions.

9. A layered broadband sparse acoustic absorber comprising a periodic array of laterally spaced-apart, two-sided Helmholtz resonators, the periodic array comprising:

a first plurality of unit cells spaced apart by a lateral midpoint-to-midpoint distance P, each unit cell having a maximum lateral dimension W, wherein P is greater than W, and each unit cell comprising:

a first Helmholtz resonator having:

a first chamber portion bounded by at least one first boundary wall defining a first chamber volume; and a first longitudinal neck forming an opening on a first side of the at least one first boundary wall and placing the first chamber portion in fluid communication with an ambient environment; and a second Helmholtz resonator having:

a second chamber portion bounded by at least one second boundary wall defining a second chamber volume equal to the first chamber volume; and a first lateral neck forming an opening on a second side of the at least one second boundary wall, the second side being substantially perpendicular to the first side, and placing the second chamber portion in fluid communication with the ambient environment a second plurality of unit cells, layered relative to the first plurality, and spaced apart by the lateral midpoint-to-midpoint distance P, each unit cell having the maximum lateral dimension W, and each unit cell of the second plurality comprising:

a third Helmholtz resonator having:

a third chamber portion bounded by at least one first boundary wall defining a third chamber volume; and a second longitudinal neck forming an opening on a third side of the at least one third boundary wall and placing the third chamber portion in fluid communication with an ambient environment; and a fourth Helmholtz resonator having:

a fourth chamber portion bounded by at least one fourth boundary wall defining a fourth chamber volume equal to the third chamber volume; and a second lateral neck forming an opening on a fourth side of the at least one fourth boundary wall, the fourth side being substantially perpendicular to the third side, and placing the fourth chamber portion in fluid communication with the ambient environment.

10. The layered broadband sparse acoustic absorber as recited in claim 9, wherein the first and third chamber volumes are different.

11. The layered broadband sparse acoustic absorber as recited in claim 9, comprising an acoustically absorbing medium covering the first and second longitudinal neck of each unit cell in the first and second plurality.

12. The layered broadband sparse acoustic absorber as recited in claim 9, comprising an acoustically absorbing medium covering the first and second longitudinal neck, and contiguously filling the first and second longitudinal neck and a fraction of the first and third chamber portion of each unit cell in the first and second plurality.

13. The layered broadband acoustic absorber as recited in claim 12, wherein the acoustically absorbing medium comprises a melamine or polyurethane foam.

14. The layered broadband sparse acoustic absorber as recited in claim 9, wherein the first longitudinal neck and the first lateral neck are separated by a first longitudinal distance, and the second longitudinal neck and the second lateral neck are separated by a second longitudinal distance that differs from the first longitudinal distance.

15. A sound suppression system comprising:

a sound emitting device;

one or more broadband sparse acoustic absorbers at least partially surrounding the sound emitting device, each of the one or more broadband sparse acoustic absorbers comprising:

a plurality of unit cells spaced apart by a lateral midpoint-to-midpoint distance P, each unit cell having a maximum lateral dimension W, wherein P is greater than W, and each unit cell comprising:

a first Helmholtz resonator having:

a first chamber portion bounded by at least one first boundary wall defining a first chamber volume; and a longitudinal neck forming an opening on a first side of the at least one first boundary wall and placing the first chamber portion in fluid communication with an ambient environment; and a second Helmholtz resonator having:

a second chamber portion bounded by at least one second boundary wall defining a second chamber volume equal to the first chamber volume; and a lateral neck forming an opening on a second side of the at least one second boundary wall, the second side being substantially perpendicular to the first side, and placing the second chamber portion in fluid communication with the ambient environment.

16. The system as recited in claim 15, wherein the sound emitting device comprises an internal combustion engine.

17. The system as recited in claim 15, comprising an acoustically absorbing medium covering the longitudinal neck of each unit cell.

18. The system as recited in claim 15, comprising an acoustically absorbing medium covering the longitudinal neck, and contiguously filling the longitudinal neck and a fraction of the first chamber portion of each unit cell.

19. The system as recited in claim 18, wherein the acoustically absorbing medium comprises a melamine or polyurethane foam.

20. The system as recited in claim 15, comprising a coolant, configured to absorb heat from the sound emitting device, passing through one or more interstices in the one or more broadband sparse acoustic absorbers.

* * * * *